United States Patent [19]

Hagiri

[11] Patent Number: 4,705,774

[45] Date of Patent: Nov. 10, 1987

[54] THERMOSENSITIVE IMAGE TRANSFER MEDIUM

[75] Inventor: Minoru Hagiri, Numazu, Japan

[73] Assignee: Ricoh Company, Ltd., Tokyo, Japan

[21] Appl. No.: 874,669

[22] Filed: Jun. 16, 1986

[30] Foreign Application Priority Data

Jun. 17, 1985 [JP] Japan ..... 60-131074

[51] Int. Cl.[4] ..... B41M 5/22

[52] U.S. Cl. ..... 503/207; 503/200; 503/208; 503/216; 503/220; 503/221; 503/223; 503/226; 427/152

[58] Field of Search ..... 346/200, 207, 226, 208, 346/216, 217, 220, 221, 223; 427/150–152

[56] References Cited

FOREIGN PATENT DOCUMENTS 0086789 6/1980 Japan ..... 346/226
0140590 11/1980 Japan ..... 346/207
0027394 3/1981 Japan ..... 346/226
0044687 4/1981 Japan ..... 346/226

*Primary Examiner*—Bruce H. Hess
*Attorney, Agent, or Firm*—Oblon, Fisher, Spivak, McClelland, & Maier

[57] ABSTRACT

A thermosensitive image transfer medium is disclosed which consists essentially of (i) an image transfer sheet comprising (a) a plastic film, (b) an undercoat layer formed thereon containing a porous filler having an average particle size of 1 to 10 μm and an oil absorption of 200 ml/100 g or less as measured in accordance with the Japanese Industrial Standard K 5101, with a depostion of the porous filler ranging from 1 g/m$^2$ to 10 g/m$^2$ and (c) an image transfer layer comprising a leuco dye formed on the undercoat layer, and (ii) an acceptor sheet having an acceptor layer comprising a color developer which is capable of inducing color formation in the leuco dye.

11 Claims, No Drawings

THERMOSENSITIVE IMAGE TRANSFER MEDIUM

BACKGROUND OF THE INVENTION

The present invention relates to a thermosensitive image transfer medium utilizing a thermal coloring reaction between a leuco dye and a color developer, which is capable of yielding colored images with high and uniform image density by application of a small quantity thermal energy thereto even if image transfer is done multiple times.

Conventionally, there are known several thermosensitive image transfer mediums. For example, a thermosensitive image transfer medium consisting of (i) an image transfer sheet comprising a sublimation-type dye layer formed on a support material and (ii) an acceptor sheet capable of accepting the sublimated dye images from the sublimation-type dye layer of the image transfer sheet when thermal printing is performed from the back side of the image transfer sheet.

Another conventional thermosensitive image transfer medium consists of (i) an image transfer sheet comprising an image transfer layer formed on a support material, which image transfer layer comprises a thermofusible material and a pigment or a dye, and (ii) an acceptor sheet.

The former thermosensitive image transfer material has the shortcomings that the dye images on the acceptor sheet are poor in preservability because of the use of the sublimation-type dye and therefore an overcoating must be provided on the transferred images.

In the latter thermosensitive image transfer medium, the image transfer layer contains a pigment or a dye dispersed in the thermofusible material. If a large quantity of the pigment is contained in the image transfer layer in an attempt of obtaining images with high density, the image transfer ratio decreases. The result is that it becomes difficult to obtain images with high density. If a large quantity of a thermofusible material is contained in the image transfer layer in order to increase the thermosensitivity, a large quantity of the thermofusible material is transferred from the transfer sheet to the acceptor sheet. As a result, it becomes difficult to peel the transfer sheet off the acceptor sheet smoothly, so that line images on the acceptor sheet become unclear.

In addition to the above-described conventional thermosensitive image transfer mediums, a further thermal printing type thermosensitive image transfer medium is known, in which materials which react with each other to form a color upon application of heat thereto are supported separately in the form of two layers, each layer on a different support material, and thermal printing is performed by bringing the two layers into close contact with each other. In thermosensitive image transfer mediums of this type, the coloring reaction does not occur sufficiently if the image transfer layer is merely transferred to the acceptor layer by bringing them into contact with each other, thus yielding images having low image density. If thermal printing were performed at high temperatures with application of heat for a long period of time for allowing the coloring reaction to take place sufficiently, images having high density would be obtained on the acceptor sheet. However, the coloring reaction would also take place on the image transfer sheet at the same time. In other words, image formation occurs on both the acceptor sheet and the image transfer sheet.

A further variety of thermosensitive image transfer mediums of the above-mentioned type have been proposed in an attempt to obtain transferred images with uniform density even if image transfer is performed multiple times from the same image transfer medium.

For instance, in a thermosensitive image transfer medium of the above type, a porous filler having an oil absorption of 50 ml/100 g or more is contained in an image transfer layer which comprises as the main component a leuco dye.

In another thermosensitive image transfer medium, the image transfer sheet comprises a plastic film, a porous-filler-containing layer which contains a porous filler having an oil absorption of 50 to 300 ml/100 g formed on the plastic film and an image transfer layer comprising as the main component a leuco dye formed on the porous-filler-containing layer.

In a further thermosensitive image transfer medium, the image transfer sheet comprises a support material having a 0.5 to 3 μm surface roughness and an image transfer layer formed on the support material.

These conventional thermosensitive image transfer mediums, however, are not capable of obtaining sufficiently high and uniform image density for use in practice at multiple image transfer from the same image transfer medium.

SUMMARY OF THE INVENTION

It is therefore an object of the present invention to provide a thermosensitive image transfer medium capable of yielding colored images with high and uniform image density by application of a small quantity thermal energy thereto even if image transfer is performed multiple times. This thermosensitive image transfer medium utilizes a thermal coloring reaction between a leuco dye and a color developer and attains smooth transfer of a small amount of the leuco dye from an image transfer layer to an image acceptor layer of the thermosensitive image transfer medium in each image transfer step.

This object of the present invention can be attained by a thermosensitive image transfer medium consisting of (i) an image transfer sheet having an image transfer layer which comprises a leuco dye, and (ii) an acceptor sheet having an acceptor layer which comprises a color developer capable of inducing color formation in the leuco dye upon application of heat thereto, which image transfer sheet comprises (a) a plastic film, (b) an undercoat layer formed thereon containing a porous filler having an average particle size of 1 to 10 μm and an oil absorption of 200 ml/100 g or less as measured in accordance with the Japanese Industrial Standard K 5101, with a depostion of the porous filler ranging from 1 $g/m^2$ to 10 $g/m^2$ and (c) the above-mentioned image transfer layer formed on the undercoat layer.

DETAILED DESCRIPTION OF THE PREFERRED EMBODIMENTS

In the thermosensitive image transfer medium according to the present invention, image formation is performed by superimposing the acceptor sheet on the image transfer sheet in such a manner that the acceptor layer of the acceptor sheet comes into close contact with the image transfer layer of the image transfer sheet, and performing thermal printing, for instance, with application of heat to the back side of the image transfer sheet, whereby images can be formed on the surface of the acceptor layer of the acceptor sheet.

In the present invention, as described previously, as the support material of the image transfer sheet, a plastic film is employed, and the undercoat layer comprising a porous filler having an average particle size of 1 to 10 μm and an oil absorption of 200 ml/100 g or less is formed on the plastic film, with a deposition thereof being in the range of 1 g/m$^2$ to 10 g/m$^2$. Because of this particular structure of the image transfer sheet, the dye component can be transferred uniformly from the image transfer layer to the acceptor layer, while a large quantity of the dye is retained within the image transfer layer during the image transfer steps. At each image transfer step, a small amount of the dye is transported from the image transfer layer to the acceptor layer. Thus, the same image transfer sheet can be used many times in the present invention with formation of the colored images with uniform density on each acceptor sheet.

As mentioned above, the porous filler for use in the present invention has an average particle size ranging from 1 μm to 10 μm and an oil absorption of 200 ml/100 g or less for obtaining high image density and high image transfer efficiency.

Specific examples of the porous filler of use in the present invention are organic or inorganic powder of silica, aluminum silicate, alumina, aluminum hydroxide, magnesium hydroxide, urea-formaldehyde resin and styrene resin.

Specific examples of the plastic film for use as the support material of the image transfer sheet are polyester film, polyamide film, polyvinyl chloride film, polyethylene film, polypropylene film and other conventional plastic films.

When the porous-filler-containing undercoat layer is formed on the plastic film, a variety of binder agents are employed as will be described later.

As the leuco dye for use in the image transfer layer, conventional leuco dyes for use in pressure-sensitive paper and heat-sensitive paper can be employed, for example, triphenylmethane-type, fluoran-type, phenothiazine-type, auramine-type and spiropyran-type leuco dyes.

Specific examples of these leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-metyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide, The acceptor sheet for use in the present invention comprises a support material made of, for example, paper, synthetic paper or plastic film, and the acceptor layer formed on the support material. The acceptor layer contains as the main component a color developer which induces color formation in the leuco dye upon application of heat thereto. As the color developer, electron acceptor materials, for instance, phenolic materials, organic acids, salts thereof or esters thereof can be employed. Color developers having a melting point not higher than 200° C. are preferable for use in practice.

Specific examples of the color developers for use in the present invention are as follows:

| | Melting Point (°C.) |
|---|---|
| 4-tert-butylphenol | 98 |
| 4-hydroxydiphenyl ether | 84 |
| 1-naphthol | 98 |
| 2-naphthol | 121 |
| methyl-4-hydroxybenzoate | 131 |
| 4-hydroxyacetophenone | 109 |
| 2,2'-dihydroxydiphenyl ether | 79 |
| 4-phenylphenol | 166 |
| 4-tert-octylcatechol | 109 |
| 2,2'-dihydroxydiphenyl | 103 |
| 4,4'-methylenebisphenol | 160 |
| 2,2'-methylenebis(4-chlorophenol) | 164 |
| 2,2'-methylenebis(4-methyl-6-tert-butylphenol) | 125 |
| 4,4'-isopropylidenediphenol | 156 |
| 4,4'-isopropylidenebis(2-chlorophenol) | 90 |
| 4,4'-isopropylidenebis(2,6-dibromophenol) | 172 |
| 4,4'-isopropylidenebis(2-tert-butylphenol) | 110 |
| 4,4'-isopropylidenebis(2-methylphenol) | 136 |
| 4,4'-isopropylidenebis(2,6-dimethylphenol) | 168 |
| 4,4'-sec-butylidenediphenol | 119 |
| 4,4'-sec-butylidenebis(2-methylphenol) | 142 |
| 4,4'-cyclohexylidenediphenol | 180 |
| 4,4'-cyclohexylidenebis(2-methylphenol) | 184 |
| salicylic acid | 163 |
| salicylic acid m-tolyl ester | 74 |
| salicylic acid phenacyl ester | 110 |
| 4-hydroxybenzoic acid methyl ester | 131 |
| 4-hydroxybenzoic acid ethyl ester | 116 |
| 4-hydroxybenzoic acid propyl ester | 98 |
| 4-hydroxybenzoic acid isopropyl ester | 86 |
| 4-hydroxybenzoic acid butyl ester | 71 |
| 4-hydroxybenzoic acid isoamyl ester | 50 |
| 4-hydroxybenzoic acid phenyl ester | 178 |
| 4-hydroxybenzoic acid benzyl ester | 111 |
| 4-hydroxybenzoic acid cyclohexyl ester | 119 |
| 5-hydroxysalicylic acid | 200 |
| 5-chlorosalicylic acid | 172 |
| 3-chlorosalicylic acid | 178 |
| thiosalicylic acid | 164 |
| 2-chloro-5-nitrobenzoic acid | 165 |
| 4-methoxyphenol | 53 |
| 2-hydroxybenzyl alcohol | 87 |

-continued

| | Melting Point (°C.) |
|---|---|
| 2,5-dimethylphenol | 75 |
| benzoic acid | 122 |
| o-toluic acid | 107 |
| m-toluic acid | 111 |
| p-toluic acid | 181 |
| o-chlorobenzoic acid | 142 |
| m-hydroxybenzoic acid | 200 |
| 2,4-dihydroxyacetophenone | 97 |
| resorcinol monobenzoate | 135 |
| 4-hydroxybenzophenone | 133 |
| 2,4-dihydroxybenzophenone | 144 |
| 2-naphthoic acid | 184 |
| 1-hydroxy-2-naphthoic acid | 195 |
| 3,4-dihydroxybenzoic acid ethyl ester | 128 |
| 3,4-dihydroxybenzoic acid phenyl ester | 189 |
| 4-hydroxypropiophenone | 150 |
| salicylosalicylate | 148 |
| phthalic acid monobenzyl ester | 107 |
| 1,1-bis(4'-hydroxyphenyl)ethane | 126 |
| 1,1-bis(4'-hydroxyphenyl)propane | 130 |
| 1,1-bis(4'-hydroxyphenyl)hexane | 111 |
| 1,1-bis(4'-hydroxyphenyl)heptane | 120 |
| 1,1-bis(4'-hydroxyphenyl)propylpentane | 128 |
| 1,1-bis(4'-hydroxyphenyl)-2-ethylhexane | 87 |
| 2,2-bis(4'-hydroxyphenyl)heptane | 101 |
| 3,3-bis(4'-hydroxyphenyl)hexane | 155 |
| 1,1-bis(3'-methyl-4'-hydroxyphenyl)ethane | 101 |
| 1,1-bis(3'-methyl-4'-hydroxyphenyl)propane | 94 |
| 1,1-bis(3'-methyl-4'-hydroxyphenyl)butane | 135 |
| 1,1-bis(3'-methyl-4'-hydroxyphenyl)pentane | 97 |
| 1,1-bis(3'-methyl-4'-hydroxyphenyl)hexane | 78 |
| 1,1-bis(3'-methyl-4'-hydroxyphenyl)heptane | 85 |
| 2-(3'-methyl-4'-hydroxyphenyl-2-(4'-hydroxyphenyl)propane | 120 |
| 2,2-bis(3'-methyl-4'-hydroxyphenyl)pentane | 128 |
| 2,2-bis(5'-methyl-4'-hydroxyphenyl)hexane | 104 |
| 2,2-bis(3'-methyl-4'-hydroxyphenyl)4-methylpentane | 129 |
| 1,1-bis(3'-methyl-4'-hydroxyphenyl)4-methylbutane | 124 |
| 3,3-bis(3'-methyl-4'-hydroxyphenyl)hexane | 90 |
| 5,5-bis(3'-methyl-4'-hydroxyphenyl)nonane | 128 |
| 2,(4'-hydroxyphenyl)-2-(3'-chloro-4'-hydroxyphenyl)propane | 101 |
| 2,2-bis(3'-isopropyl-4'-hydroxyphenyl)propane | 97 |
| 2,2-bis(3'-tert-butyl-4'-hydroxyphenyl)propane | 117 |
| 2,2-bis(3'-chloro-4'-hydroxyphenyl)propane | 84 |
| 2-(4'-hydroxy-3',5'-dimethylphenyl)-2-(4'-hydroxyphenyl)propane | 127 |
| bis(3'-methyl-5'-ethyl-4'-hydroxyphenyl)methane | 105 |
| 1,1-(3'-methyl-5'-butyl-4'-hydroxyphenyl)butane | 104 |
| 2,2-bis(4-hydroxyphenyl)octane | 83 |
| bis(4-hydroxyphenylmercapto)methane | 55 |
| 1,2-bis(4-hydroxyphenylmercapto)ethane | 173 |
| 1,3-bis(4-hydroxyphenylmercapto)propane | 82 |
| 1,4-bis(4-hydroxyphenylmercapto)butane | 182 |
| 1,5-bis(4-hydroxyphenylmercapto)pentane | 98 |
| 1,6-bis(4-hydroxyphenylmercapto)hexane | 166 |
| 1,3-bis(4-hydroxyphenylmercapto)acetone | 74 |
| 1,5-bis(4-hydroxyphenylmercapto)-3-oxapenthane | 93 |
| 1,7-bis(4-hydroxyphenylmercapto)-3,5-dioxaheptane | 108 |
| 1,8-bis(4-hydroxyphenylmercapto)-3,5-dioxaoctane | 100 |
| 4-benzylmercaptophenol | 104 |
| 4-p-phlorobenzylmercaptophenol | 90 |
| 4-p-methylbenzylmercaptophenol | |

When the image transfer layer and the acceptor layer are formed on the respective support materials, for example, the following conventional binder agents can be employed: polyvinyl alcohol, methoxycellulose, hydroxyethylcellulose, carboxymethylcellulose, polyvinylpyrrolidone, polyacrylamide, polyacrylic acid, starch, gelatin, polystyrene, vinylchloride/vinyl acetate copolymer, polybutylmethacrylate, which are soluble in water or organic solvents, or can be made in the form of an aqueous emulsion.

For forming the image transfer layer, the following resins whose melting or softening points are in the range of 50° C. to 130° C. are preferable for use as the binder agent for the image transfer layer: polyethylene, polypropylene, polystyrene, petroleum resin, acrylic resin, vinyl chloride resin, vinyl acetate resin, vinylidene chloride resin, polyvinyl alcohol, cellulose resin, polyamide, polyacetal, polycarbonate, polyester, fluorine-contained resin, silicone resin, natural rubber, chlorinated rubber, butadiene rubber, olefine rubber, phenolic resin, urea resin, melamine resin, epoxy resin and polyimide.

In the present invention, as described previously, since the porous filler with the particular oil absorption is contained in the image transfer layer of the image transfer sheet, the dye component can be transferred uniformly from the image transfer layer to the acceptor layer, while a large quantity of the dye is retained within the image transfer layer during the image transfer steps. At each image transfer step, a small amount of the dye is transported from the image transfer layer to the acceptor layer. Thus, the same image transfer sheet can be used many times in the present invention with formation of the colored images with uniform density on each acceptor sheet.

As mentioned previously, the porous filler for use in the image transfer layer has an oil absorption of 200 ml/100 g or less (which is measured in accordance with the Japanese Industrial Standard K 5101 method).

In the present invention, a porous filler with an oil absorption of 50 ml/100 g or more, preferably a porous filler with an oil absorption of 150 ml/100 g or more, (which is measured in accordance with the Japanese Industrial Standard K 5101 method) can also be contained in the acceptor layer, but this can be omitted when unnecessary. When the porous fillers is contained in the acceptor layer, the amount of the filler is in range of 0.01 part by weight or more, preferably in the range of 0.05 parts by weight to 10 part by weight, more preferably in the range 0.1 part by weight to 3 parts by weight, with respect to 1 part by weight of the color developer.

Specific examples of the porous filler for use in the acceptor layer are organic or inorganic powders of silica, aluminium silicate, alumina, aluminum hydroxide, magnesium hydroxide, urea-formaldehyde resin and styrene resin.

The thermosensitive image transfer medium according to the present invention can be prepared by dispersing or dissolving the above described components for each layer together with a solvent such as water in a ball mill or in an attritor to prepare each layer formation liquid and by applying each layer formation liquid to each support material in an amount ranging from 0.3 to 30 g/m$^2$ on a dry basis.

With reference to the following Examples, the present invention will now be explained in detail. As a matter of course, the present invention is not limited to these examples.

EXAMPLE 1

[Preparation of Image Transfer Sheet A-1]

The following components were dispersed in a ball mill for 24 hours to prepare a support material coating liquid:

| | Parts by Weight |
|---|---|
| Acryl polyol | 10 |
| Polyisocyanate | 3 |
| Finely-divided silica particles (average particle size of 1.0 μm and oil absorption of 190 ml/100 g) | 8 |
| Methyl ethyl ketone | 75 |

The thus prepared coating liquid was applied by a wire bar to a polyester film with a thickness of 6 μm, with a deposition of 1.1 g/m$^2$ of the solid components thereof on a dry basis, whereby a support material was prepared.

The following components were dispersed in a ball mill for 24 hours to prepare an image transfer layer formation liquid.

| | Parts by Weight |
|---|---|
| 3-N—methyl-N—cyclohexylamino-6-methyl-7-anilinofluoran | 10 |
| Polyester resin (poly(ε-caprolactone), M.W. 10,000 and m.p. 59° C.) | 2 |
| Methyl ethyl ketone | 100 |

The thus prepared image transfer layer formation liquid was applied by a wire bar to the above prepared support material, with a deposition of the above solid components thereof in an amount of 3 g/m$^2$ on a dry basis, whereby an image transfer sheet A-1 was prepared.

[Preparation of Acceptor Sheet B-1]

The following components were dispersed in a ball mill for 24 hours to prepare an acceptor layer formation liquid. The thus prepared acceptor layer formation liquid was applied to a sheet of high quality paper (35 g/m$^2$) by a wire bar, with a deposition of the solid components thereof in an amount of 5 g/m$^2$ when dried, whereby an acceptor sheet B-1 was prepared.

| | Parts by Weight |
|---|---|
| n-butyl 4-hydroxybenzoate | 20 |
| Silica particles (with an oil absorption 200 ml/100 g) | 10 |
| Polyvinyl alcohol | 3 |
| Water | 100 |

The image transfer sheet A-1 was superimposed on the acceptor sheet B-1 in such a manner that the image transfer layer of the image transfer sheet A-1 was in close contact with the acceptor layer of the acceptor sheet B-1, and 1 mJ of thermal energy was applied through a thermal head to the back side of the image transfer sheet A-1. As a result, black images were formed on the acceptor sheet B-1. The image density of the thus obtained images was measured by use of a Macbeth densitometer (RD-514). The result is shown in Table 1.

From the above image transfer sheet A-1, 10 copies were made by using 10 new acceptor sheets B-1 successively. The transferred images were almost the same in image density in the first copy through the 10th copy as specifically shown in Table 1.

EXAMPLE 2

Example 1 was repeated except that in the formulation of the coating liquid for the support material of the image transfer sheet A-1 in Example 1, the finely-divided silica particles employed in Example 1 were replaced by finely-divided silica particles having an average particle size of 4.2 μm and an oil absorption of 90 ml/100 g and the deposition amount of the coating liquid was changed from 1.1 g/m$^2$ to 5 g/m$^2$ on a dry basis, so that an image transfer sheet A-2 was prepared.

By use of the thus prepared image transfer sheet A-2 and the acceptor sheet B-1 prepared in Example 1, image formation was carried out in the same manner as in Example 1. As a result, black images were formed on the acceptor sheet B-1. The image density of the images was measured by the Macbeth densitometer in the same manner as in Example 1. The result is shown in Table 1.

From the above image transfer sheet A-2, 10 copies were made using 10 new acceptor sheets B-1 successively. The transferred images were almost the same in image density in the first copy through the 10th copy as specifically shown in Table 1.

EXAMPLE 3

Example 1 was repeated except that in the formulation of the coating liquid for the support material of the image transfer sheet A-1 in Example 1, the finely-divided silica particles employed in Example 1 were replaced by finely-divided silica particles having an average particle size of 7.0 μm and an oil absorption of 150 ml/100 g and the deposition amount of the coating liquid was changed from 1.1 g/m$^2$ to 9.8 g/m$^2$ on a dry basis, so that an image transfer sheet A-3 was prepared.

By use of the thus prepared image transfer sheet A-3 and the acceptor sheet B-1 prepared in Example 1, image formation was carried out in the same manner as in Example 1. As a result, black images were formed on the acceptor sheet B-1. The image density of the images was measured by the Macbeth densitometer in the same manner as in Example 1. The result is shown in Table 1.

From the above image transfer sheet A-3, 10 copies were made by using 10 new acceptor sheets B-1 successively. The transferred images were almost the same in image density in the first copy through the 10th copy as specifically shown in Table 1.

EXAMPLE 4

Example 1 was repeated except that the coating liquid for the support material of the image transfer sheet employed in Example 1 was replaced by the following coating liquid which was prepared by dispersing the following components in a ball mill for 12 hours and that the deposition amount of the coating liquid was changed from 1.1 g/m$^2$ to 3.3 g/m$^2$, whereby an image transfer sheet A-4 was prepared.

| | Parts by Weight |
|---|---|
| Melamine resin ("Uvan 60R" made by Mitsui Toatsu Chemicals, Inc.) | 4 |
| Thermosetting Type Acrylic Resin ("Almatex MT-748" made by Mitsui Toatsu Chemicals, Inc.) | 8 |
| Urea - formaldehyde resin (average particle size of 20 μm and oil absorption of 150 ml/100 g) | 6 |

-continued

| | Parts by Weight |
|---|---|
| Methyl cellosolve | 70 |

By use of the thus prepared image transfer sheet A-4 and the acceptor sheet B-1 prepared in Example 1, image formation was carried out in the same manner as in Example 1. As a result, black images were formed on the acceptor sheet B-1. The image density of the images was measured by the Macbeth densitometer in the same manner as in Example 1. The result is shown in Table 1.

From the above image transfer sheet A-4, 10 copies were made by using 10 new acceptor sheets B-1 successively. The transferred images were almost the same in image density in the first copy through the 10th copy as specifically shown in Table 1.

EXAMPLE 5

Example 4 was repeated except that in the formulation of the coating liquid for the support material of the image transfer sheet A-4 in Example 4, the urea-formaldehyde resin employed in Example 4 was replaced by an urea-formaldehyde resin having an average particle size of 5 μm and an oil absorption of 200 ml/100 g and the deposition amount of the coating liquid was changed from 3.3 g/m$^2$ to 7.2 g/m$^2$ on a dry basis, so that an image transfer sheet A-5 was prepared.

By use of the thus prepared image transfer sheet A-5 and the acceptor sheet B-1 prepared in Example 1, image formation was carried out in the same manner as in Example 1. As a result, black images were formed on the acceptor sheet B-1. The image density of the images was measured by the Macbeth densitometer in the same manner as in Example 1. The result is shown in Table 1.

From the above image transfer sheet A-5, 10 copies were made by using 10 new acceptor sheets B-1 successively. The transferred images were almost the same in image density in the first copy through the 10th copy as specifically shown in Table 1.

COMPARATIVE EXAMPLE 1

Example 1 was repeated except that the image transfer layer formation liquid prepared in Example 1 was applied directly to the same polyester film as that employed in Example 1, without applying the coating liquid to the polyester film, whereby a comparative image transfer sheet CA-1 was prepared.

By use of the thus prepared comparative image transfer sheet CA-1 and the acceptor sheet B-1 prepared in Example 1, image formation was carried out in the same manner as in Example 1. As a result, black images were formed on the acceptor sheet B-1. The image density of the images was measured by the Macbeth densitometer in the same manner as in Example 1. The result is shown in Table 1.

From the above comparative image transfer sheet CA-1, 10 copies were made by using 10 new acceptor sheets B-1 successively. The image density considerably decreased from the fifth copy on as specifically shown in Table 1.

COMPARATIVE EXAMPLE 2

[Preparation of Comparative Image Transfer Sheet CA-2]

The following components were dispersed in a ball mill for 24 hours to prepare a comparative support material coating liquid:

| | Parts by Weight |
|---|---|
| Acryl polyol | 10 |
| Polyisocyanate | 3 |
| Finely-divided silica particles (average particle size of 12 μm and oil absorption of 50 ml/100 g) | 8 |
| Methyl ethyl ketone | 75 |

The thus prepared comparative coating liquid was applied by a wire bar to a polyester film having a thickness of 6 μm, with a deposition of 10 g/m$^2$ of the solid components thereof on a dry basis, whereby a comparative support material was prepared.

The same image transfer layer formation liquid as that employed in Example 1 was applied by a wire bar to the above prepared comparative support material, with a deposition of 3 g/m$^2$ of the above solid components on a dry basis, whereby a comparative image transfer sheet CA-2 was prepared.

By use of the thus prepared comparative image transfer sheet CA-2 and the acceptor sheet B-1 prepared in Example 1, image formation was carried out in the same manner as in Example 1. As a result, black images were formed on the acceptor sheet B-1. The image density of the images was measured by the Macbeth densitometer in the same manner as in Example 1. As shown in Table 1, the image density was low.

From the above comparative image transfer sheet CA-2, 10 copies were made by using 10 new acceptor sheets B-1 successively. The image density was considerably low from the first copy as specifically shown in Table 1.

COMPARATIVE EXAMPLE 3

[Preparation of Comparative Image Transfer Sheet CA-3]

The following components were dispersed in a ball mill for 24 hours to prepare a comparative support material coating liquid:

| | Parts by Weight |
|---|---|
| Acryl polyol | 10 |
| Polyisocyanate | 3 |
| Finely-divided silica particles (average particle size of 0.1 μm and oil absorption of 280 ml/100 g) | 8 |
| Methyl ethyl ketone | 75 |

The thus prepared comparative coating liquid was applied by a wire bar to a polyester film having a thickness of 6 μm, with a deposition of 0.5 g/m$^2$ of the solid components thereof on a dry basis, whereby a comparative support material was prepared.

The same image transfer layer formation liquid as that employed in Example 1 was applied by a wire bar to the above prepared comparative support material, with a deposition of 3 g/m$^2$ of the above solid components on a dry basis, whereby a comparative image transfer sheet CA-3 was prepared.

By use of the thus prepared comparative image transfer sheet CA-3 and the acceptor sheet B-1 prepared in Example 1, image formation was carried out in the same manner as in Example 1. As a result, black images were formed on the acceptor sheet B-1. The image density of the images was measured by the Macbeth densitometer in the same manner as in Example 1. As shown in Table 1, the image density was low.

From the above comparative image transfer sheet CA-3, 10 copies were made by using 10 new acceptor sheets B-1 successively. The image density considerably was low from the first copy and remarkably decreased from the fifth copy as specifically shown in Table 1.

TABLE 1

| | Image Transfer Sheet | Image Density Number of Copies | | |
|---|---|---|---|---|
| | | 1 | 5 | 10 |
| Example 1 | A-1 | 1.30 | 1.25 | 1.20 |
| Example 2 | A-2 | 1.28 | 1.26 | 1.18 |
| Example 3 | A-3 | 1.18 | 1.14 | 1.09 |
| Example 4 | A-4 | 1.25 | 1.22 | 1.18 |
| Example 5 | A-5 | 1.20 | 1.17 | 1.09 |
| Comparative Example 1 | CA-1 | 1.35 | 0.32 | 0.26 |
| Comparative Example 2 | CA-2 | 0.65 | 0.42 | 0.30 |
| Comparative Example 3 | CA-3 | 1.00 | 0.42 | 0.31 |

What is claimed is:

1. A thermosensitive image transfer medium consisting essentially of (i) an image transfer sheet comprising (a) a plastic film, (b) an undercoat layer formed thereon containing a porous filler having an average particle size of 1 to 10 μm and an oil absorption of 200 ml/100 g or less as measured in accordance with the Japanese Industrial Standard K 5101, with said porous filler being deposited in the amount of from 1 g/m$^2$ to 10 g/m$^2$ and (c) an image transfer layer comprising a leuco dye formed on said undercoat layer, and (ii) an acceptor sheet having an acceptor layer comprising a color developer which is capable of inducing color formation in said leuco dye.

2. The thermosensitive image transfer medium as recited in claim 1, wherein said porous filler contained in said undercoat layer is selected from the group consisting of silica, aluminum silicate, alumina, aluminum hydroxide, magnesium hydroxide, urea-formaldehyde resin and styrene resin.

3. The thermosensitive image transfer medium as recited in claim 1, wherein said leuco dye is selected from the group consisting of triphenylmethane-type leuco dyes, fluoran-type leuco dyes, phenothiazine-type leuco dyes, auramine-type leuco dyes and spiropyran-type leuco dyes.

4. The thermosensitive image transfer medium as recited in claim 3, wherein said leuco dye is selected from the group consisting of:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide, and
3-(2'-methoxy-4'-dimethylaminophenyl)-3-(2'-hydroxy-4'-chloro-5'-methylphenyl)phthalide.

5. The thermosensitive image transfer medium as recited in claim 1, wherein said color developer contained in said acceptor layer is an electron acceptor material.

6. The thermosensitive image transfer medium as recited in claim 5, wherein said electron acceptor material has a melting point being not higher than 200° C.

7. The thermosensitive image transfer medium as recited in claim 6, wherein said electron acceptor material is selected from the group consisting of:

4-tert-butylphenol
4-hydroxydiphenyl ether
1-naphthol
2-naphthol
methyl-4-hydroxybenzoate
4-hydroxyacetophenone
2,2'-dihydroxydiphenyl ether
4-phenylphenol
4-tert-octylcatechol
2,2'-dihydroxydiphenyl
4,4'-methylenebisphenol
2,2'-methylenebis(4-chlorophenol)
2,2'-methylenebis(4-methyl-6-tert-butylphenol)
4,4'-isopropylidenediphenol
4,4'-isopropylidenebis(2-chlorophenol)
4,4'-isopropylidenebis(2,6-dibromophenol)
4,4'-isopropylidenebis(2-tert-butylphenol)
4,4'-isopropylidenebis(2-methylphenol)
4,4'-isopropylidenebis(2,6-dimethylphenol)
4,4'-sec-butylidenediphenol
4,4'-sec-butylidenebis(2-methylphenol)
4,4'-cyclohexylidenediphenol
4,4'-cyclohexylidenebis(2-methylphenol)
salicylic acid
salicylic acid m-tolyl ester
salicylic acid phenacyl ester
4-hydroxybenzoic acid methyl ester
4-hydroxybenzoic acid ethyl ester
4-hydroxybenzoic acid propyl ester 4-hydroxybenzoic acid isopropyl ester
4-hydroxybenzoic acid butyl ester
4-hydroxybenzoic acid isoamyl ester
4-hydroxybenzoic acid phenyl ester
4-hydroxybenzoic acid benzyl ester
4-hydroxybenzoic acid cyclohexyl ester
5-hydroxysalicylic acid
5-chlorosalicylic acid
3-chlorosalicylic acid
thiosalicylic acid
2-chloro-5-nitrobenzoic acid
4-methoxyphenol
2-hydroxybenzyl alcohol
2,5-dimethylphenol
benzoic acid
o-toluic acid
m-toluic acid
p-toluic acid
o-chlorobenzoic acid
m-hydroxybenzoic acid
2,4-dihydroxyacetophenone
resorcinol monobenzoate
4-hydroxybenzophenone
2,4-dihydroxybenzophenone
2-naphthoic acid
1-hydroxy-2-naphthoic acid
3,4-dihydroxybenzoic acid ethyl ester
3,4-dihydroxybenzoic acid phenyl ester
4-hydroxypropiophenone
salicylosalicylate
phthalic acid monobenzyl ester
1,1-bis(4'-hydroxyphenyl)ethane
1,1-bis(4'-hydroxyphenyl)propane
1,1-bis(4'-hydroxyphenyl)hexane
1,1-bis(4'-hydroxyphenyl)heptane
1,1-bis(4'-hydroxyphenyl)propylpentane
1,1-bis(4'-hydroxyphenyl)-2-ethylhexane
2,2-bis(4'-hydroxyphenyl)heptane
3,3-bis(4'-hydroxyphenyl)hexane
1,1-bis(3'-methyl-4'-hydroxyphenyl)ethane
1,1-bis(3'-methyl-4'-hydroxyphenyl)propane
1,1-bis(3'-methyl-4'-hydroxyphenyl)butane
1,1-bis(3'-methyl-4'-hydroxyphenyl)pentane
1,1-bis(3'-methyl-4'-hydroxyphenyl)hexane
1,1-bis(3'-methyl-4'-hydroxyphenyl)heptane
2-(3'-methyl-4'-hydroxyphenyl-2-(4'-hydroxyphenyl)-propane
2,2-bis(3'-methyl-4'-hydroxyphenyl)pentane
2,2-bis(5'-methyl-4'-hydroxyphenyl)hexane
2,2-bis(3'-methyl-4'-hydroxyphenyl)4-methylpentane
1,1-bis(3'-methyl-4'-hydroxyphenyl)4-methylbutane
3,3-bis(3'-methyl-4'-hydroxyphenyl)hexane
5,5-bis(3'-methyl-4'-hydroxyphenyl)nonane
2,(4'-hydroxyphenyl)-2-(3'-chloro-4'-hydroxyphenyl)-propane
2,2-bis(3'-isopropyl-4'-hydroxyphenyl)propane
2,2-bis(3'-tert-butyl-4'-hydroxyphenyl)propane
2,2-bis(3'-chloro-4'-hydroxyphenyl)propane
2-(4'-hydroxy-3',5'-dimethylphenyl)-2-(4'-hydroxy-phenyl)propane
bis(3'-methyl-5'-ethyl-4'-hydroxyphenyl)methane
1,1-(3'-methyl-5'-butyl-4'-hydroxyphenyl)butane
2,2-bis(4-hydroxyphenyl)octane
bis(4-hydroxyphenylmercapto)methane
1,2-bis(4-hydroxyphenylmercapto)ethane
1,3-bis(4-hydroxyphenylmercapto)propane
1,4-bis(4-hydroxyphenylmercapto)butane
1,5-bis(4-hydroxyphenylmercapto)pentane
1,6-bis(4-hydroxyphenylmercapto)hexane
1,3-bis(4-hydroxyphenylmercapto)acetone
1,5-bis(4-hydroxyphenylmercapto)-3-oxapenthane
1,7-bis(4-hydroxyphenylmercapto)-3,5-dioxahepthane
1,8-bis(4-hydroxyphenylmercapto)-3,5-dioxaoctane
4-benzylmercaptophenol
4-p-phlorobenzylmercaptophenol and
4-p-methylbenzylmercaptophenol.

8. The thermosensitive image transfer medium as recited in claim 1, wherein said acceptor layer further comprises a porous filler having an oil absorption of 50 ml/100 g or more as measured in accordance with the Japanese Industrial Standard K 5101.

9. The thermosensitive image transfer medium as recited in claim 8, wherein the amount of said porous filler is at least 0.01 part by weight with respect to 1 part by weight of said color developer.

10. The thermosensitive image transfer medium as recited in claim 8, wherein said porous filler contained in said undercoat layer is selected from the group consisting of silica, aluminum silicate, alumina, aluminum hydroxide, magnesium hydroxide, urea-formaldehyde resin and styrene resin.

11. The thermoplastic image transfer medium as recited in claim 1, wherein said plastic film is selected from the group consisting of polyethylene, polypropylene, polystyrene, petroleum resin, acrylic resin, vinyl chloride resin, vinyl acetate resin, vinylidene chloride resin, polyvinyl alcohol, cellulose resin, polyamide, polyacetal, polycarbonate, polyester, fluorine-contained resin, silicone resin, natural rubber, chlorinated rubber, butadiene rubber, olefin rubber, phenolic resin, urea resin, melamine resin, epoxy resin and polyimide.

* * * * *